US005100200A

United States Patent [19]

Keusch et al.

[11] Patent Number: 5,100,200

[45] Date of Patent: Mar. 31, 1992

[54] CHAIR, IN PARTICULAR WORK OR OFFICE CHAIR

[75] Inventors: Siegfried Keusch, Plochingen; Gunter Kratz, Hochdorf, both of Fed. Rep. of Germany

[73] Assignee: Roeder GmbH, Fed. Rep. of Germany

[21] Appl. No.: 477,936

[22] PCT Filed: Dec. 3, 1988

[86] PCT No.: PCT/DE88/00749

§ 371 Date: Aug. 20, 1990

§ 102(e) Date: Aug. 20, 1990

[87] PCT Pub. No.: WO89/06099

PCT Pub. Date: Jul. 13, 1989

[30] Foreign Application Priority Data

Dec. 29, 1987 [DE] Fed. Rep. of Germany ..... 3744363

[51] Int. Cl.[5] ..... A47C 3/00

[52] U.S. Cl. ..... 297/296; 297/353; 297/354

[58] Field of Search ..... 297/343, 353, 354, 355, 297/356, 357, 358, 61

[56] References Cited

U.S. PATENT DOCUMENTS

| | | | |
|---|---|---|---|
| 2,992,855 | 7/1961 | Mohler | 297/353 |
| 4,452,486 | 6/1984 | Zapf et al. | 297/343 |
| 4,456,298 | 6/1984 | Gottstein | 297/353 |
| 4,502,729 | 3/1985 | Locher | 297/343 X |
| 4,536,031 | 8/1985 | Latone | 297/353 |
| 4,632,458 | 12/1986 | Brown et al. | 297/353 |
| 4,697,846 | 10/1987 | Lucci et al. | 297/343 X |
| 4,786,108 | 11/1988 | Dauphin | 297/353 |

*Primary Examiner*—Peter A. Aschenbrenner
*Attorney, Agent, or Firm*—Speckman & Pauley

[57] ABSTRACT

A chair, in particular a work or office chair, having a backrest rod which can be adjustably tilted with respect to a seat and a backrest displaceable thereon by means of a slider. When tilted back, the slider is slidable with respect to the backrest rod, in a direction of the seat with a displacement device. The backrest is connected with a cradle which is displaceable over a predetermined displacement path and lockable in several positions with respect to the slider. The displacement device has only a single toggle joint seated pivotally around a horizontal pivot shaft on a pillow block supporting the seat or a seat support which is adjustable in inclination towards the pillow block. An extension of the backrest is flexibly connected with a lever end of one lever arm of the toggle joint. Another lever end of another lever arm of the toggle joint is pivotal with a retaining bolt of the backrest rod and the seat support in such a way, that during backward tilting of backrest rod or lowering of the seat support, the one lever arm of the toggle joint displaces the extension and the backrest towards the pillow block or the seat support.

8 Claims, 2 Drawing Sheets

CHAIR, IN PARTICULAR WORK OR OFFICE CHAIR

BACKGROUND OF THE INVENTION

1. Field of the Invention

This invention relates to a chair, in particular a work or office chair, with a backrest frame, the tilt of which can be adjusted relative to the seat and with a backrest support member, displaceable thereon by means of a slider or the like, where, when tilting back, the slider is slidable in or on the backrest frame in the direction of the seat by means of a displacement device.

2. Description of Prior Art

Known chairs of this type offer excellent seating comfort because they result in a definite support of the back of the user in the initial or working position, because of the practically vertical position of the backrest and they permit relaxed sitting when the backrest frame is tilted back. When the backrest frame is tilted back, the upper torso of the user does not simply perform a pivot movement, but there is a movement in which several components are superimposed on each other. Because the backrest performs an additional downward movement when the backrest frame is tilted back, relative movement between the back of the user and the backrest is avoided or at least reduced to the point where it is no longer noticeable.

These known chairs have the disadvantage that in the steep initial position the backrest assumes a defined position relative to the seat, which is adapted to the size of the body of the user. Because the backrest has an anatomically adapted shape, optimum seating comfort can only be achieved by a user with an average body size.

SUMMARY OF THE INVENTION

It is the object of the invention to achieve in a chair of the type mentioned above that, besides the compensation of the relative movement between the body of the user and the backrest during tilting back of the backrest rod, there is the additional possibility for bringing the backrest into an initial position which is adapted to the body size of the user.

In accordance with the invention this object is attained in that the backrest is connected with a cradle or the like, which is additionally displaceable over a predetermined displacement path and fixable in several positions in or on the slider.

By means of the backrest support member or the like, which is displaceable with respect to the slider or the like, without affecting the displacement path of the slider or the like, which takes place automatically via the displacement device, the backrest with the backrest support member or the like can be brought into an initial position, which is adapted to the body size of the user, over a separate displacement path. In this way the anatomical design of the backrest takes full effect for every user regardless of the body size, which is also accomplished with relatively minimal additional effort.

Setting of the backrest support member into several definite positions on its displacement path in or on the slider is accomplished in a simple manner in that a spring with a lock bolt is disposed on the cradle which can engage one or a plurality of bores of the slider. The spring can be disengaged and in this way the locked connection between the lock bolt and the slider can be interrupted with a key disposed in the backrest frame.

After the key has been released, the lock position between the lock bolt and the slider is automatically assumed if the key is fixed on the slider with an elastic element serving as a restoring spring and, by means of extensions, is brought behind the spring in the highest position of the backrest, and thus of the backrest support member.

In a particularly advantageous embodiment of this invention the spring is in the form of a U-shaped leaf spring which laterally encloses the backrest support member with its lateral arms and is supported by its cross arm on the side of the backrest support member facing the seat on the side of the slider facing the backrest. The key is disposed on the side of the backrest, frame facing away from the backrest outside of the displacement path of the backrest. The key is thus always easily accessible and the spring with the lock bolt can be easily housed in the backrest frame.

The locking force is transferred symmetrically and evenly to the lock bolt if the embodiment is such that the lock bolt is centered on the cross arm of the spring and extends away from it in the direction of the slider, and the row of bores in the slider is centered and placed at even intervals.

The displacement of the backrest support member in or on the slider is limited by stops, preferably disposed on the slider.

The engagement of the lock bolt in a bore of the slider is improved in that the free end of the lock bolt terminates in an insertion tip, an insertion truncated cone shape or the like.

The displacement device for the slider is preferably designed in such a way that the displacement device has only a single toggle joint pivotally seated around a pivot shaft on a pillow block supporting the seat or on a seat support which is adjustable in its inclination towards the pillow block or seat support. An extension of the slider is flexibly connected with the end of one lever arm of the toggle joint and the end of the other lever arm of the toggle joint is pivotal by means of a retaining bolt or the like of the backrest frame and/or the seat support in such a way, that during backward tilting of the backrest frame and/or lowering of the seat support the one lever arm of the toggle joint displaces the extension and thus the backrest in the direction towards the pillow block or seat support.

BRIEF DESCRIPTION OF DRAWINGS

The invention will be described in detail by means of an exemplary embodiment shown in the drawings wherein.

DESCRIPTION OF PREFERRED EMBODIMENTS

Figure 1:
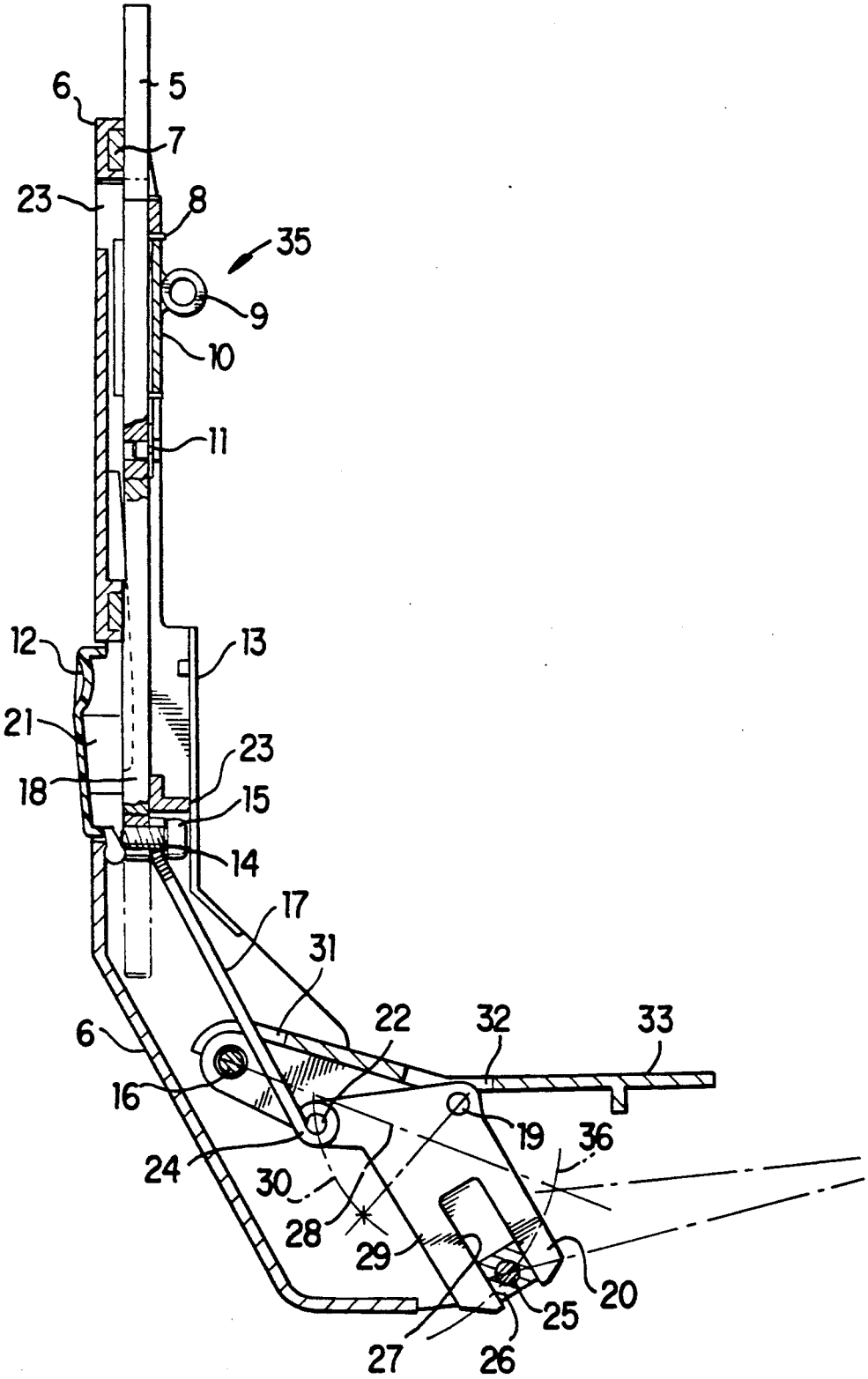
FIG. 1 shows a longitudinal section of the backrest frame with a slider and a backrest support member bearing the back rest (not shown), as well as the displacement device for displacing the slider in the backrest frame.
Figure 2:
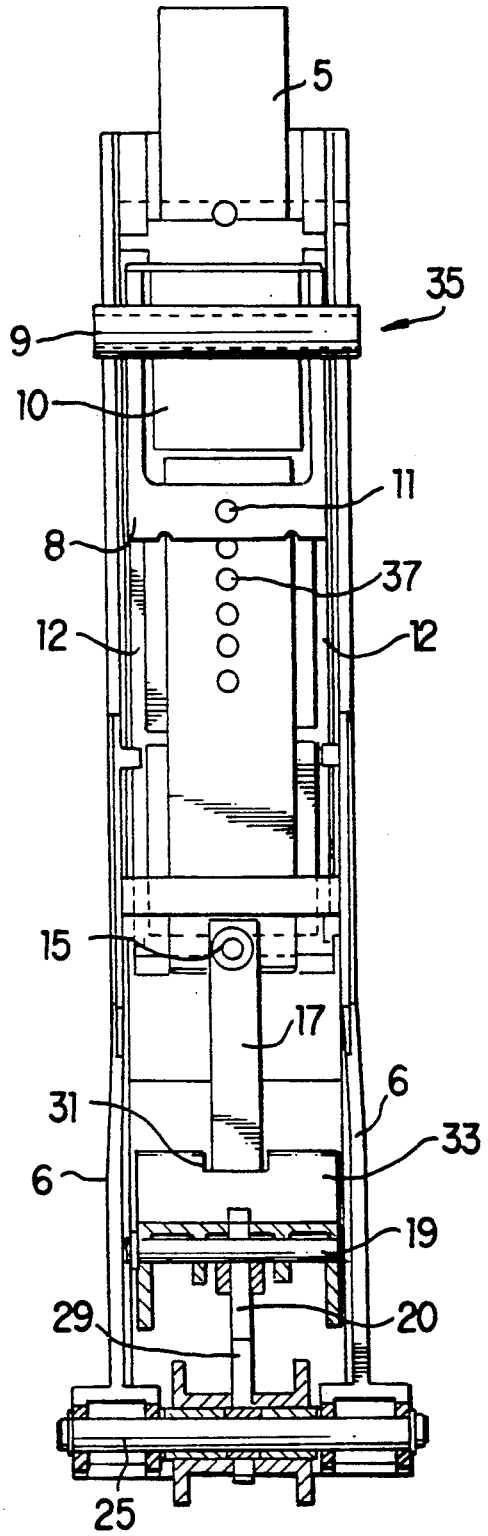
FIG. 2 shows a partial view of the parts in accordance with FIG. 1, on the side facing the backrest.

The exemplary embodiment in accordance with FIGS. 1 and 2 shows a chair where the backrest frame 6 may be pivotally seated on the pillow block or seat support 33. In this embodiment, the illustration has been limited to those parts which are required for placing the backrest into an initial position and for the automatic displacement of the backrest in or on the backrest frame 6. A displacement device with the toggle joint 20 is shown in FIG. 1, which may be seated either in the fixed pillow block of a chair seat support 33 or in the pillow block or seat support 33, which is adjustable in its inclination.

The slider 5 is displaceably guided in the backrest frame 6, damping elements 7 preventing or damping the noise of backrest displacement. The support member 10 is movably secured to and displaceably guided on the slider 5. The backrest support member 10 supports the horizontal tube section 9, on which the backrest (not shown) is fixed. Between the slider 5 and the backrest support member 10 the spring 8 in the form of a U-shaped leaf spring is positioned, which laterally encloses the backrest support member 10 with its lateral arms and which is supported with its cross arm below the backrest support member 10, on the side of the slider 5 facing towards the backrest. The slider 5 has a row of bores 37, as shown in FIG. 2, in its center which are placed at even intervals. The cross arm of the spring 8 supports on its center the lock bolt 11 which extends away from it in the direction of the slider 5 and terminates on its free end preferably in an insertion tip, an insertion truncated cone shape or the like, so that it can engage more easily a bore 37 of the slider 5.

On the side facing away from the backrest, the key 12 is built into the backrest frame 6 outside of the displacement area of the backrest, which can enclose the backrest frame 6 and take it up in a receiver. Two extensions of the key 12 rise upward on the sides of the slider 5 and extend behind the spring 8, even when the backrest support member 10 is in its highest position on the slider 5. Therefore, the spring 8 can be disengaged by pressure on the key 12 and the locked connection between the lock bolt 11 and the slider 5 can be interrupted. Then the backrest support member 10 with the backrest can be displaced on the slider 5 until the lock bolt 11 again engages a bore 37 of the slider 5, after the key 12 has been released. The displacement path of the backrest support member 10 on the slider 5 is limited to a predetermined value by catches of the slider 5, which, for example, may have the form of pins placed into the bores. The displacement path of the backrest support member 10 on the slider 5 is limited by the backrest support member 10 being stopped by the catches. This additional possibility of displacing the backrest on the slider 5, which itself is automatically displaced in or on the backrest frame 6 in course of the backward tilting of the backrest frame 6, permits an initial positioning of the backrest when the backrest frame 6 steeply extends upward and thus adaptation of the anatomically designed backrest to the body size of the user, so as to attain optimum seating comfort adapted to the body size of the user in all positions of the backrest frame 6.

The key 12 is supported on the slider 5 by means of the elastic element 21, which may be in the form of a block of foam material, for example, covered by an adhesive foil 18. This elastic element 21 acts as a restoring spring, which restores the key 12 after it has been released. At the same time the spring 8 is released for engagement of the lock bolt 11 in a bore 37 of the slider 5.

The displacement device for the slider 5 is in the form of a toggle joint 20 in the embodiment shown in the drawings, which is rotatably seated with the pivot shaft 19 in the form of a seating bolt on the fixed pillow block support 33, or, on the pillow block or seat support 33 which is adjustable in its inclination. In such embodiment, the seating bolt is seated in the lateral arms of the pillow block or seat support 33. The opening 32 provides space for the toggle joint 20, so that the structural height can be kept low. The backrest frame 6 is also provided with lateral arms and open towards the backrest. The pillow block or seat support 33 extends between the lateral arms of the backrest frame 6 and is rotatably seated in it by means of the pivot shaft 16, in the form of a seating bolt. In the area where they are seated, the pillow block or seat support 33 has the recess 31, through which the extension 17 is brought and flexibly seated on the hinge pin 22 by means of the bearing sleeve 24. The hinge pin 22 is disposed at the end of the one lever arm 28 of the toggle joint 20 which, in the initial position of the chair, i.e. with the backrest frame 6 extended steeply upwards, extends approximately horizontal, the same as the pillow block or seat support 33. In the area of the backrest frame 6 which is extended beyond the pivot shaft 16, the retaining bolt 25 is fixed and held in the sliding pad 26. The sliding pad 26 is displaceably seated in the guide slit 27 of the other lever arm 29 of the toggle joint 20. During pivoting of the toggle joint 20, the hinge pin 22 moves over a track 30 located on a circular path around the pivot shaft 19 of the toggle joint 20. The matching of the pivot movement of the backrest frame 6 is such, that the bearing sleeve 24 of the extension 17 moves over a track which coincides with and is identical to the track 30 of the hinge pin 22. Thus, the extension 17 can be rigidly connected with the slider 5 or can be of one piece with it. An appropriate matching can be provided by the layout of the lever arms 28 and 29 of the toggle joint 20 and of the distance of the hinge pin 22 and the retaining bolt 25 from the pivot shaft 19 of the toggle joint 20. The distance of the pivot shafts 16 and 19 on the pillow block or seat support 33 is also a parameter which can be used for definition of the displacement path of the slider 5.

In the embodiment shown in the drawings, the extension 17 is a separate part, which is fixedly connected with the slider 5 by means of the connecting strip 23, the screw 15 and the spring washer 14. During pivoting, the retaining bolt 25 of the backrest frame 6 describes the track 36 located on a circular path around the pivot shaft 16. In the course of counterclockwise pivoting of the backrest rod 6, the other lever arm 29 of the toggle joint 20 is pivoted by the retaining bolt 25 in the same direction of rotation, as shown in FIG. 1. In this case, the distance of the retaining pin 25 from the pivot shaft 19 of the toggle joint 20 changes. For this reason, the retaining bolt 25, guided in the sliding pad 26, is guided longitudinally displaceable in the guide slit 27 of the other lever arm 29 of the toggle joint 20, in order to perform its pivot movement without hindrance on the track 36.

If the toggle joint 20 is pivotally seated on the seat support 33, the retaining bolt 25 is additionally guided adjustably in the guide slits of the fixed pillow block.

The cover 13 covers a portion of the open side of the backrest frame 6 outside of the displacement area of the backrest support member 10.

We claim:

1. In a chair, in particular a work or office chair, having a backrest frame a tilt of which is adjusted in relation to a seat, a backrest support member displaceable thereon by means of a slider, when tilting back said slider is slidable with respect to said backrest frame in a direction of said seat with a displacement device, the improvement comprising: said backrest support member (10) movably connected to said slider (5), said backrest support member (10) being displaceable over a displacement path and lockable in several positions with respect to said slider (5), said displacement device having only a single toggle joint (20) seated pivotally around a horizontal pivot shaft (19) on one of a fixed seat support and a seat support (33) which is adjustable in inclination, an extension (17) of said slider (5) is flexibly connected with a lever end of one lever arm (28) of said toggle joint (20), and another lever end of another lever arm (29) of said toggle joint (20) is pivotal with a retaining bolt (25) of said backrest frame (6) and said seat support (33) in such a way, that during backward tilting of at least one of said backrest frame (6) and lowering of said seat support said one lever arm (28) of said toggle joint (20) displaces said extension (17) and said backrest (35) towards said seat support (33).

2. In a chair according to claim 1, wherein a spring (8) with a lock bolt (11) is positioned on said backrest support member (10), which said lock bolt (11) can engage at least one bore (37) of said slider (5), forming a locked connection, and a key (12) is positioned in said backrest frame (6) which can disengage said spring (8) and said locked connection between said lock bolt (11) and said slider (5).

3. In a chair according to claim 2, wherein said key (12) is supported on said slider (5) by means of an elastic element (21) acting as a restoring spring and is positioned behind said spring (8) with extensions in a highest position of said backrest support member (10).

4. In a chair according to claim 3, wherein said spring (8) is in a form of a U-shaped leaf spring which laterally encloses said backrest support member (10) with lateral arms and which is supported by a cross arm on a backrest support member side of said backrest support member (10) facing said seat on a slider side of said slider (5) facing said backrest support member (10), and said key (12) is positioned on a backrest frame side of said backrest frame (6) facing away from said backrest support member, outside of a displacement path of said backrest support member.

5. In a chair according to claim 4, wherein said lock bolt (11) is centered on said cross arm of said spring (8) and extends away in a direction of said slider (5), and said slider (5) has a row of bores (37) centered and placed at even intervals.

6. In a chair according to claim 1, wherein said key (12) is supported on said slider (5) by means of an elastic element (21) acting as a restoring spring and is positioned behind said spring (8) with extensions in a highest position of said backrest support member (10).

7. In a chair according to claim 1, wherein said spring (8) is in a form of a U-shaped leaf spring which laterally encloses said backrest support member (10) with lateral arms and which is supported by a cross arm on a backrest support member side of said backrest support member (10) facing said seat on a slider side of said slider (5) facing said backrest support member (10), and said key (12) is positioned on a backrest frame side of said backrest frame (6) facing away from said backrest support member (10), outside of a displacement path of said backrest support member (10).

8. In a chair according to claim 1, wherein said lock bolt (11) is centered on said cross arm of said spring (8) and extends away in a direction of said slider (5), and said slider (5) has a row of bores (37) centered and placed at even intervals.

* * * * *